US005785105A

United States Patent [19]

Crider et al.

[11] Patent Number: 5,785,105

[45] Date of Patent: Jul. 28, 1998

[54] SEALABLE CURTAIN

[76] Inventors: Grant W. Crider, Rte. 1, Box 17, Breman, Ala. 35033; Charles H. Harbison, 3217 Georgetown Pl., Birmingham, Ala. 35216

[21] Appl. No.: 733,784

[22] Filed: Oct. 18, 1996

Related U.S. Application Data

[63] Continuation-in-part of Ser. No. 556,484, Nov. 13, 1995, Pat. No. 5,566,736, and Ser. No. 684,992, Jul. 22, 1996.

[51] Int. Cl.[6] ..... A47G 5/02

[52] U.S. Cl. ..... 160/243; 160/85; 160/268.1

[58] Field of Search ..... 160/85, 86, 120, 160/121.1, 122, 242, 243, 266, 268.1, 270, 271, 273.1

[56] References Cited

U.S. PATENT DOCUMENTS

| | | | |
|---|---|---|---|
| 2,349,368 | 5/1944 | Myers | 160/85 X |
| 3,464,480 | 9/1969 | Kuss | 160/243 |
| 3,789,904 | 2/1974 | Takazawa | 160/120 |
| 3,980,122 | 9/1976 | Takazawa | 160/120 X |
| 4,344,473 | 8/1982 | Shore | 160/121.1 |
| 4,344,474 | 8/1982 | Berman | 160/121.1 |
| 4,418,739 | 12/1983 | Woolnough et al. | 160/120 |
| 4,436,137 | 3/1984 | Charles | 160/268.1 X |
| 4,453,584 | 6/1984 | Steele | 160/121.1 |
| 5,524,693 | 6/1996 | Hamilton | 160/243 |
| 5,566,736 | 10/1996 | Crider et al. | 160/121.1 |

*Primary Examiner*—David M. Purol
*Attorney, Agent, or Firm*—Veal & Associates

[57] ABSTRACT

An improved roll-up closure utilizing a flexible cover or curtain selected from a material suitable to effect the type of closure sought. The cover is at least as wide as the portal to be covered and is typically longer than the portal. Each lateral margin of the cover has a strip of hook and loop fastener material affixed thereto, and a complementary strip is affixed to the lateral margins of the structure defining the portal. A first end of the cover is rigidly affixed across a first margin of the portal. The opposite end of the cover can be upturned and connected to a driven take-up roller mounted to the first margin of the portal. In this embodiment, an elongated transverse rod is supported within the upturned end of the cover. In an alternate embodiment, the opposite end of the cover is attached to an elongated transverse rod such that as the curtain is raised or lowered, the curtain is wound or unwound around the rod, respectively. In either embodiment, activation of the driven roller lengthens or shortens the effective length of the cover while positioning the mating hook and loop fasteners to seal and unseal the cover to the lateral margins of the portal. The rod can either have sufficient weight to maintain tension on the cover such that the cover forms an adequate seal with the lateral margins of the portal, or in the alternative, a secondary rod can be utilized to maintain tension on the cover.

12 Claims, 6 Drawing Sheets

SEALABLE CURTAIN

RELATED PATENTS

This application is a continuation-in-part of U.S. patent application Ser. Nos. 08/556,484, filed Nov. 13, 1995, now U.S. Pat. No. 5,566,736 and 08/684,992, filed Jul. 22, 1996.

FIELD OF THE INVENTION

The present invention relates to the field of closures for windows, doors, or other portals and more particularly to closures which can be selectively positioned. In greater particularity the present invention relates to a non-sliding roll-up closure for a portal.

BACKGROUND OF THE INVENTION

Various applications are known wherein a portal requires a closure, or cover, to prevent the passage of wind, rain, light, insects, or any other elements through the portal. As used herein, portal simply means an opening which would allow the passage of such elements therethrough; hence a portal may be a window and the closure of the instant invention may control the passage of any of the above elements therethrough. The present invention addresses the need for improved closures for portals such as may be found on patios, pool houses, green houses, livestock houses, atriums or any other similar structures. The portal may be as small as would accommodate a ventilation fan in a gymnasium or livestock house, or as large as an atrium wall in a solar efficient building or an inclined roof panel. Additionally, the position of the portal can range from vertical to horizontal or any angle therebetween.

SUMMARY OF THE PRESENT INVENTION

It is the object of the present invention to provide a means for effectively covering portals such as windows and doors in a number of differing types of buildings.

Another object of the invention is to provide a reliable and easily operated closure for such portals.

These and other objects of the present invention are accomplished through the use of an improved roll-up closure. The closure utilizes a flexible cover or curtain selected from a material suitable to effect the type of closure sought. The cover is at least as wide as the portal to be covered and is typically longer than the portal. Each lateral margin of the cover has a strip of hook and loop fastener material affixed thereto, and a complementary strip is affixed to the lateral margins of the structure defining the portal. A first end of the cover is rigidly affixed across a first margin of the portal. The opposite end of the cover can be upturned and connected to a driven take-up roller mounted to the first margin of the portal. In this embodiment, an elongated transverse rod is supported within the upturned end of the cover. In an alternate embodiment, the opposite end of the cover is attached to an elongated transverse rod such that as the curtain is raised or lowered, the curtain is wound or unwound around the rod, respectively. In either embodiment, activation of the driven roller lengthens or shortens the effective length of the cover while positioning the mating hook and loop fasteners to seal and unseal the cover to the lateral margins of the portal. The rod can either have sufficient weight to maintain tension on the cover such that the cover forms an adequate seal with the lateral margins of the portal, or in the alternative, a secondary rod can be utilized to maintain tension on the cover.

These and other objects and advantages of the invention will become apparent from the following detailed description of the preferred embodiment of the invention.

BRIEF DESCRIPTION OF THE DRAWINGS

A closure embodying features of my invention is described in the accompanying drawings which form a portion of this disclosure and wherein.

DETAILED DESCRIPTION OF THE PREFERRED EMBODIMENT

Figure 1:
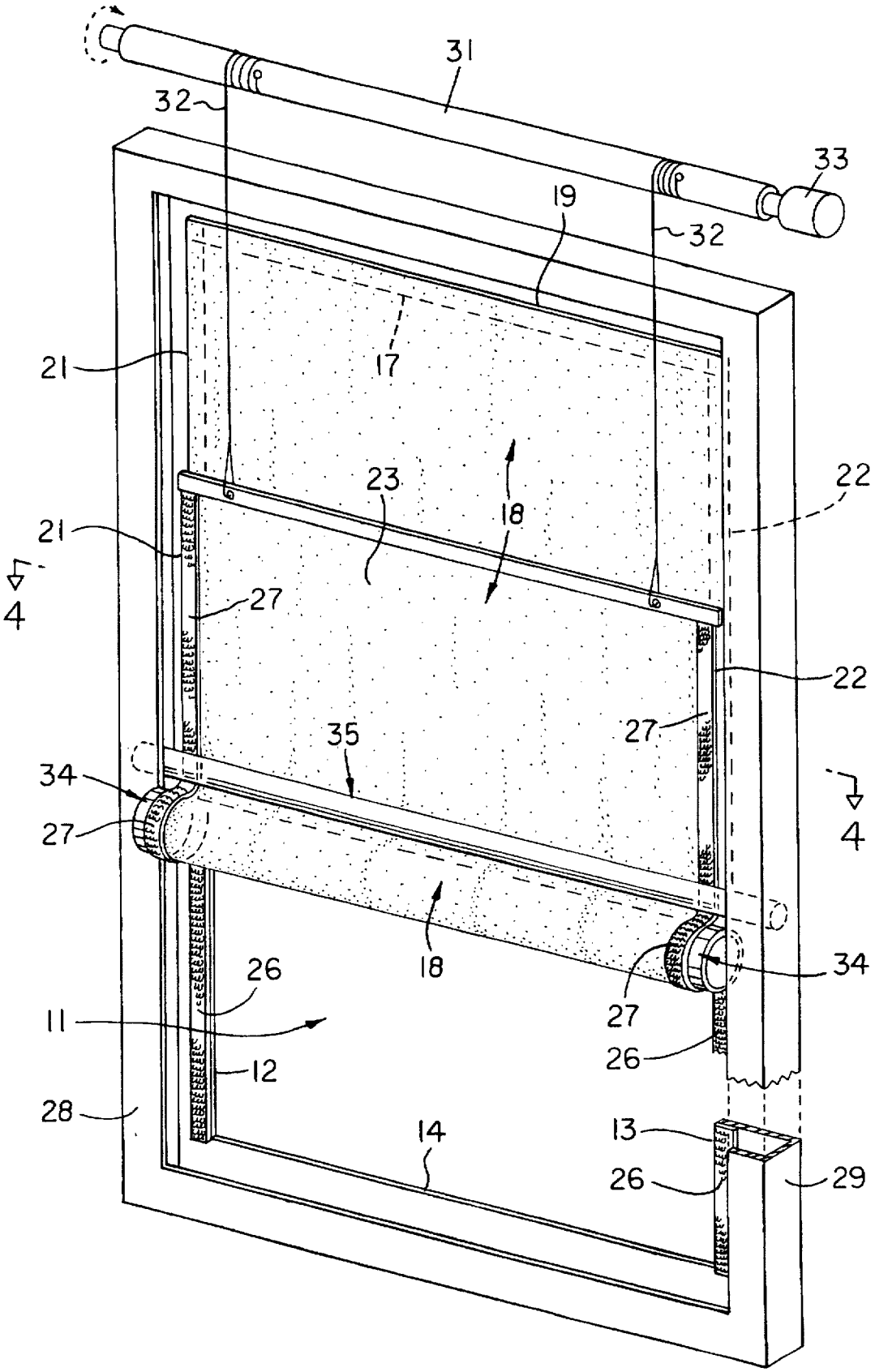
FIG. 1 is a front perspective view of the invention in a partially raised position and shown partially in section.

Pending U.S. patent application Ser. Nos. 08/556,484 and 08/684,992 are incorporated herein by reference. A more complete understanding of the invention may be obtained by reference to the accompanying drawings wherein the closure, according to the preferred embodiment, covers an opening 11 having a pair of lateral margins 12 and 13. Margins 12 and 13 extend the full vertical length of opening 11 and may terminate at a lower margin 14, which extends across the width of the opening. Across the top of opening 11 is an upper margin 17 which extends from margin 12 to margin 13. Thus, it may be seen that the opening is completely framed by margins 12, 13, 14, and 17. It is to be understood that the present invention may be positioned vertically, horizontally, or inclined, thus the terms lower or upper margin do not imply only vertical disposition of the unit.

Attached to margin 17 is a first end of a curtain 18, the curtain being comprised of a flexible material selected in accordance with the purposes of the present invention for its ability to block or transmit light, air, moisture, insects, or the like from one side to the other thereof Therefore, curtain 18 is properly defined as a flexible barrier material, having a first end 19 secured to margin 17 and opposing longitudinal sides 21 and 22, which are longer than the length of margins 12 and 13, and a lower end 23. Attached to margins 12 and 13 and to sides 21 and 22 are complementary closure members 26 and 27, such as hook and loop fastener material, which can be selectively attached and detached. Note that the closure members need only be approximately commensurate in length with the length of the margins, thus end 23 of curtain 18 does not need the fastener material. A transverse closure (not shown) may be provided in conjunction with lower margin 14; however, on a door, margin 14 would not be present.

Figure 2:
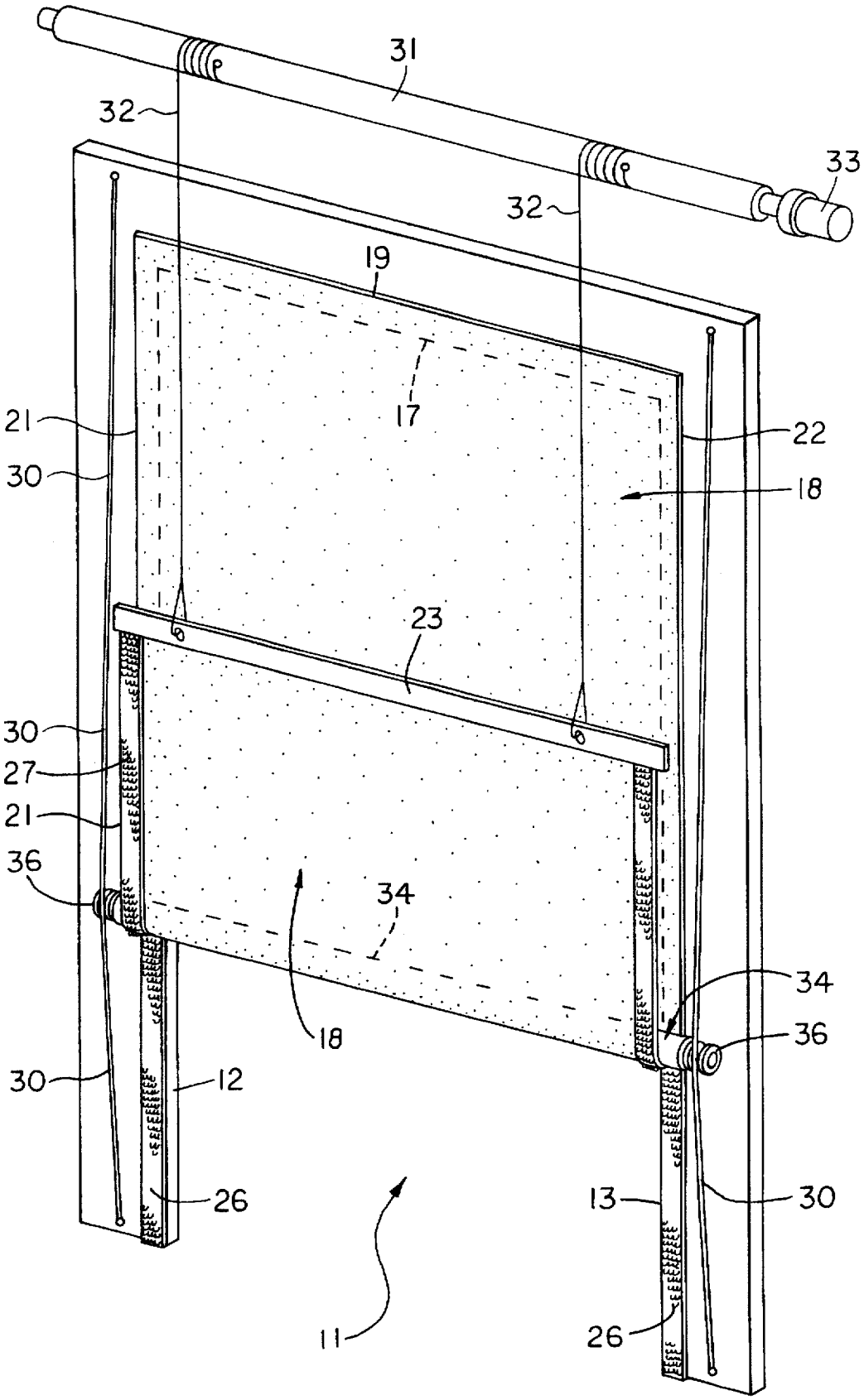
FIG. 2 is a front perspective view of an alternate embodiment of the invention in a partially raised position.

As illustrated in FIGS. 1 and 2, end 23 may be connected to a transverse take-up pipe 31 mounted for rotation above the tops of margins 12 and 13 by cables or straps 32 or, alternatively, end 23 may be directly connected to pipe 31 (not shown). In any case, pipe 31 is driven by a reversible motor 33 attached to a selected means of control (not shown) and supports end 23. An elongated rod 34, which may be a solid or tubular pipe, is supported within a pocket created by upturned end 23 such that rod 34 is lifted within the pocket as pipe 31 is rotated to wrap the straps 32 thereabout and raise the curtain. Rod 34 can have sufficient weight to maintain the curtain taut, such as in FIG. 2, or a weighted roller 35 can be included above rod 34 and separated therefrom by curtain 18, as illustrated in FIG. 1. Roller 35 is preferably supported in offset vertical relation to rod 34, although this is not critical. As pipe 31 unwraps the curtain or straps from itself, gravity urges rod 34, or roller 35 if present, and curtain 18 to a lowered position. Curtain sides 21 and 22 carrying closure 27 are pressed against complementary closure 26 of the margin as a result of rod 34 or roller 35, thereby ensuring a sealing connection. As pipe 31 raises the curtain, the lifting force is transferred around rod 34 to provide an opening force to the closures nearly normal thereto, such that they are readily detached. From the foregoing, it is easily seen that as pipe 31 rotates, it effectively varies the length of curtain 18 such that rod 34, or roller 35 if present, urges closure members 26 and 27 into sealing engagement.

Figure 3:
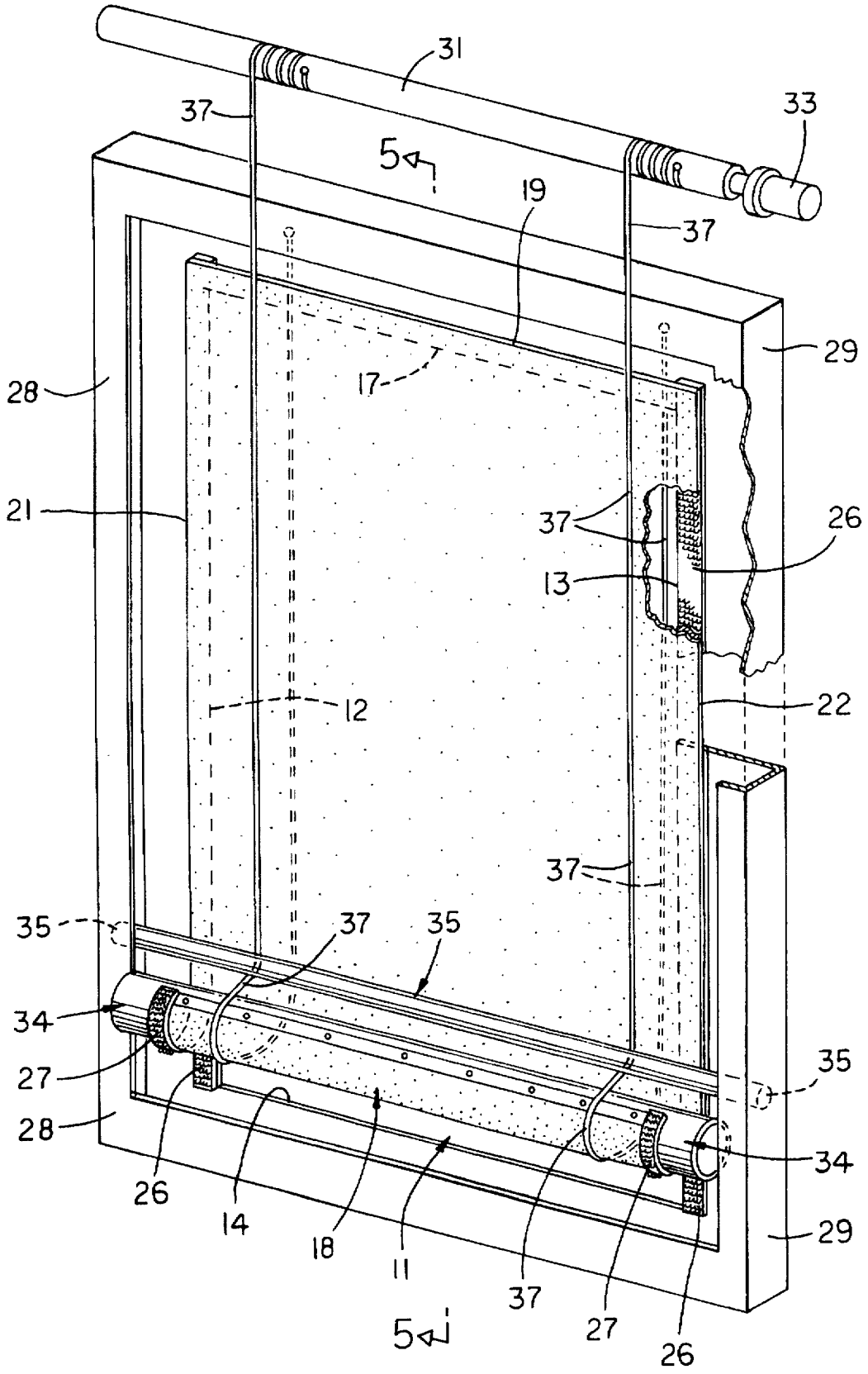
FIG. 3 is a front perspective view of another alternate embodiment of the invention shown partially in section.
Figure 4:
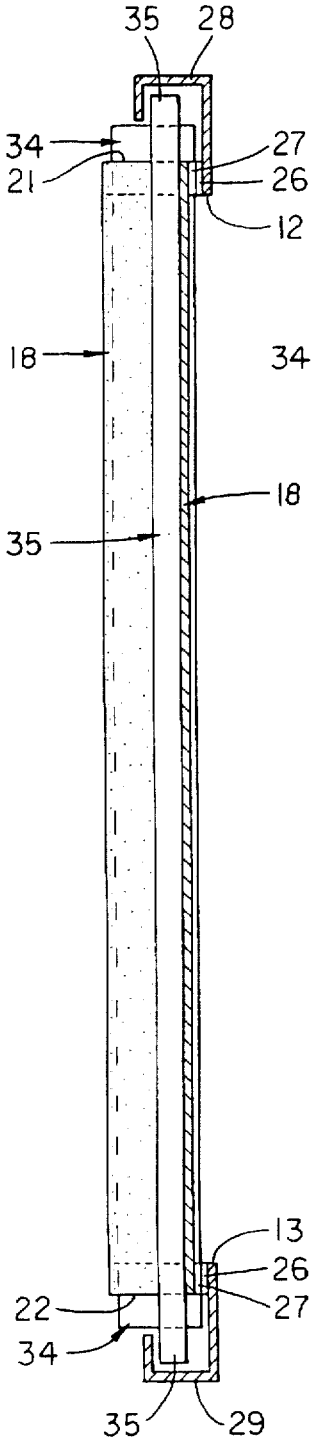
FIG. 4 is a sectional view taken along line 4—4 of FIG. 1.

Lateral margins 12 and 13 can have optional channel members 28 and 29, shown in FIGS. 1 and 3, or guide cables 30, shown in FIG. 2, attached thereto such that the opposing ends of rod 34 or roller 35 are captured by the channel members or guide cables, thus preventing the curtain from being pulled away from the portal. In the embodiment utilizing guide cables 30, it is preferable to have guide pulleys 36, which act as bearings, rotatably attached to the ends of rod 34, or roller 35, if present, to provide minimal resistance to raising and lowering of rod 34 or roller 35. As illustrated in FIGS. 1, 3 and 4, it is not necessary for the opposing ends of rod 34 to be captured within channel members 28 and 29 or guide cables 30, although this is preferred if roller 35 is not present. However, if roller 35 is present, the opposing ends of roller 35 are preferably captured within opposing channel members 28 and 29 or guide cables 30 such that roller 35 can travel vertically as pipe 31 is rotated, but cannot pivot in the horizontal plane about its mid point or move significantly along its axis. It will be appreciated that as pipe 31 rotates, rod 34 and roller 35 are constrained to rotate in opposite directions with the upturned end of flexible curtain 18 passing between them.

Figure 5:
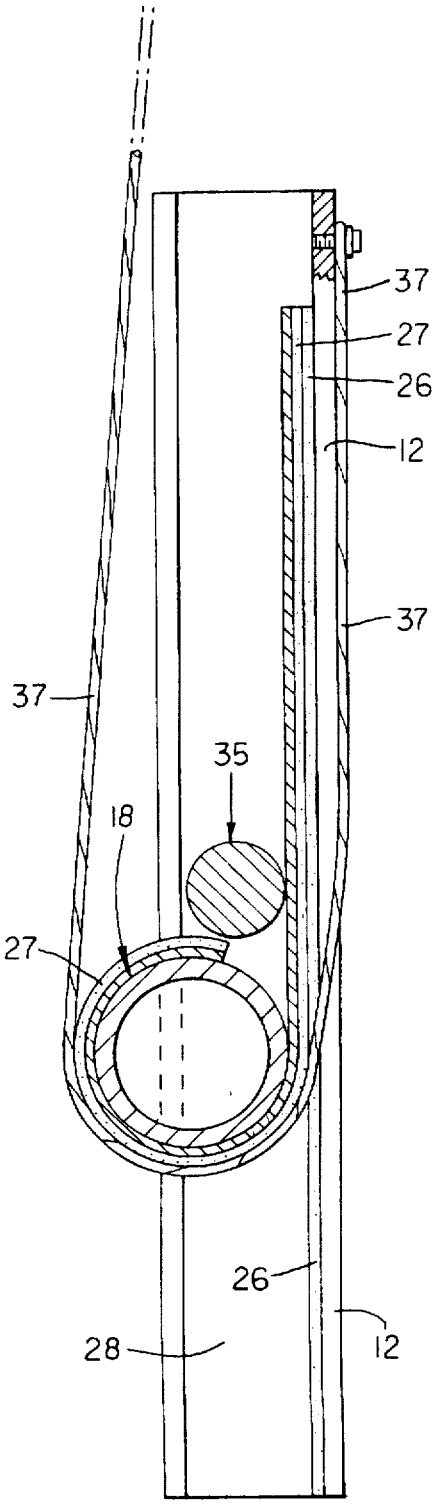
FIG. 5 is a sectional view taken along line 5—5 of FIG. 3.

In an alternate embodiment shown in FIGS. 3 and 5, lower end 23 of the curtain can be fixedly attached to rod 34. At least one cord 37 encircles rod 34 and is attached at one end to pipe 31 and at a second end to a point above the maximum height of rod 34 when fully raised. As pipe 31 rotates, cords 37 are wound around pipe 31, effectively shortening the length of cords 37. As a result, rod 34 is rotatably raised and the lower end of curtain 18 is wound around rod 34. In this embodiment, roller 35 is preferably included and is again located above rod 34 and separated therefrom by cords 37. The opposing ends of roller 35 are captured by channel members 28 and 29, or guide cables (not shown). Alternatively, roller 35 could be located between cords 37 and curtain 18, shown in FIG. 5.

Figure 6:
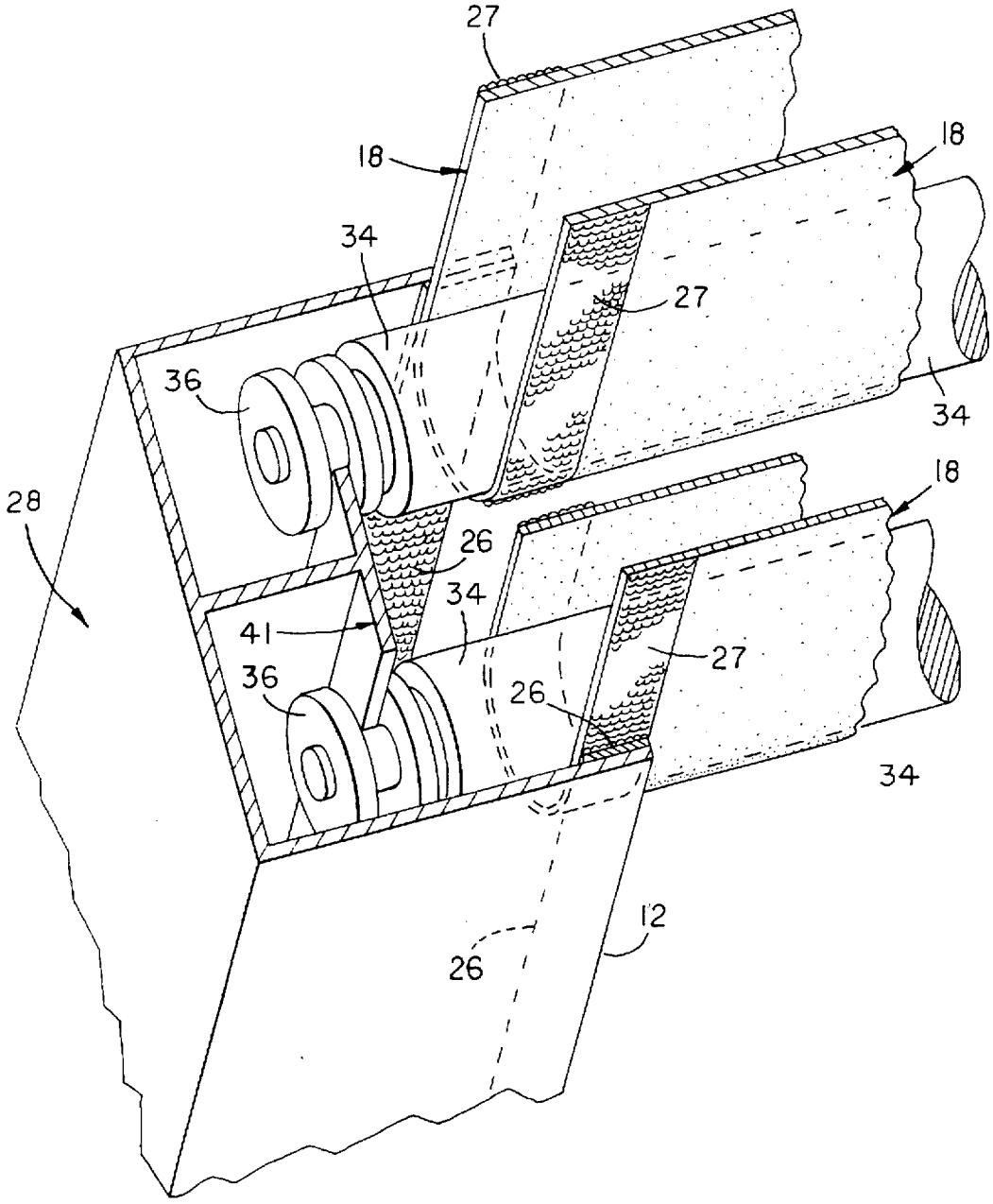
FIG. 6 is a perspective view of another alternate embodiment of the invention shown partially in section.
Figure 7:
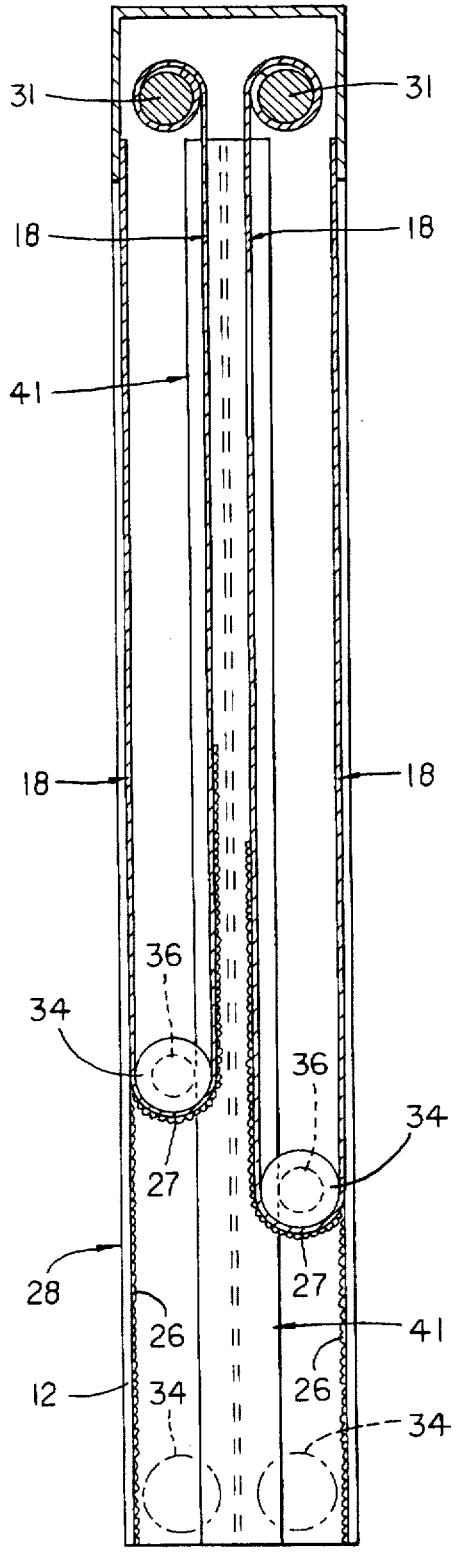
FIG. 7 is a side sectional view of the embodiment of FIG. 6.

In another alternate embodiment shown in FIGS. 6 and 7, a dual curtain assembly includes channel members 28 and 29 wherein each channel member has a rigid guide flange 41 which extends the vertical length of the channel members. In this embodiment, there are two curtains 18, two rods 34 having pulleys 36 mounted on the ends, and four sets of complementary closure members 26 and 27, with closure members 26 utilized with the curtain farthest from the portal being mounted on the channel members. Pulleys 36 engage flange 41, which is shown as a T-track, such that as pipes 31 rotate to vary the length of curtains 18, rods 34 urge closure members 26 and 27 into sealing engagement. The pulleys may be resiliently mounted or made of a resilient material to urge the closure members into sealing engagement. Pipes 31 can be independently driven such that both curtains 18 can be raised or lowered at the same time, or in the alternative, one curtain can be raised while the other is lowered. This design may become useful where the curtains are comprised of different materials suitable for different purposes and it is desirous to block various elements at the same or different times, such as sunlight only, sunlight and wind, wind only, wind and rain, etc. It should also be noted that the "T" track may be an "L" track in an assembly utilizing only one curtain.

The control mechanism may be any of a number of mechanisms depending on the needs of the application of the invention. For example, in a livestock confinement house where temperature control is a necessity, the present invention may be used as a cover for a ventilation fan, and as a variable height curtain over a window. In this situation a temperature controller such as the type manufactured by Hired Hand Manufacturing, Inc. may be attached to each motor for each curtain and constantly monitor the temperature in the house. In this manner, the fans may be uncovered and actuated, and the curtain raised or lowered to meet specific airflow conditions. In another example, the present invention may be used in a greenhouse, having a need to control the amount of sunlight on certain plants during particular months. In this situation, the motor may be controlled by a timer or may be connected to a sensing system connected to a plurality of photocells that incrementally indicate to the motor how much of the curtain should be raised or lowered. Likewise, the opening can be monitored to close during a rain shower. In the simplest case a switch to turn the motor on and off may be provided. Furthermore, limit switches of various kinds may be placed at various locations to further control the movement of the curtain, such that it may eliminate air curtains or the like.

It is ostensibly noteworthy to mention that the present invention is not limited to vertical portals, but can be used with portals ranging from vertical to horizontal or any angle therebetween. Additionally, the present invention is not susceptible to sliding friction between the parts because all of the mating surfaces are contacting each other in a rolling relationship. Therefore, wear on the curtain is minimized, and the drive units do not have to overcome friction to position the curtain. Furthermore, the curtain is not susceptible to jamming due to debris being wedged into sliding engagement with a component since no sliding movement is provided. Accordingly, we have developed a roll-up curtain system that is amenable to a variety of uses in numerous applications from residential to commercial to botanical to agricultural.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. Apparatus for opening and closing a portal in a structure comprising, in combination:

a) a pair of spaced apart opposing lateral margins of said portal;

b) a flexible curtain having elongated side portions, a first end and a second end each having a dimension commensurate with the separation of the lateral margins, with said first end being fixedly attached across said portal at an upper end thereof;

c) an elongated roller fixedly attached to said second end of said curtain;

d) means for urging said elongated roller along a vertical path such that said elongated roller is positioned at different heights; and e) a weighted roller supported on said elongated roller and separated therefrom by said urging means.

2. Apparatus as defined in claim 1 wherein said lateral margins include means for holding opposing ends of said weighted roller such that said roller may travel freely in a vertical direction but is substantially prevented from horizontal movement.

3. Apparatus as defined in claim 2 wherein said holding means comprises opposing channel members.

4. Apparatus as defined in claim 1 further comprising means for releasably and repeatedly attaching said elongated side portions to said lateral margins concomitantly with positioning said elongated roller at different heights.

5. Apparatus as defined in claim 4 wherein said attaching means includes hook and loop fasteners cooperatively affixed to said elongated portions and said lateral margins.

6. Apparatus as defined in claim 1 wherein said means for urging comprises:

(a) a driven roller mounted superjacent said portal; and (b) at least one cord encircling said elongated roller and separating said elongated roller from said weighted roller, said cord operatively attached at a first end to said driven roller and fixedly attached at a second end to a point above a position corresponding to the maximum height of said elongated roller such that as said cord is wound around said driven roller, said lower end of said curtain is wound around said elongated roller as said elongated roller is rotatably positioned at different heights.

7. Apparatus for sealably covering and uncovering a portal comprising:

a) framing means for defining a pair of opposing lateral margins of said portal;

b) a pair of parallel rollers spanning said portal, said pair including an upper roller and a lower roller wherein said upper roller is supported on and separated from said lower roller;

c) a flexible curtain spanning said portal and having a first end affixed to said framing means at a predetermined height relative to said portal, and a second end fixedly attached to said lower roller; and d) means for varying the height of said lower roller.

8. Apparatus as defined in claim 7 wherein said varying means comprises:

(a) a driven roller mounted superjacent said portal; and (b) at least one cord encircling said lower roller and separating said lower roller from said upper roller, said cord operatively attached at a first end to said driven roller and fixedly attached at a second end to a point above a position corresponding to the maximum height of said lower roller such that as said cord is wound around said driven roller, said lower end of said curtain is wound around said lower roller as said lower roller is rotatably positioned at different heights.

9. Apparatus as defined in claim 8 wherein said lateral margins include means for guiding opposing ends of said upper roller such that said upper roller may travel freely in a vertical direction but is substantially prevented from horizontal movement.

10. Apparatus as defined in claim 9 wherein said guiding means comprises opposing guide tracks.

11. Apparatus as defined in claim 8 further comprising means for releasably and repeatedly attaching said elongated side portions to said lateral margins concomitantly with positioning said lower roller at different heights.

12. Apparatus as defined in claim 11 wherein said attaching means includes hook and loop fasteners cooperatively affixed to said elongated portions and said lateral margins.

* * * * *